US009480121B2

(12) United States Patent
Blanchard et al.

(10) Patent No.: US 9,480,121 B2
(45) Date of Patent: Oct. 25, 2016

(54) APPARATUS, METHOD, AND SYSTEM FOR LED FIXTURE TEMPERATURE MEASUREMENT, CONTROL, AND CALIBRATION

(75) Inventors: David L. Blanchard, Oskalooska, IA (US); Andrew J. Schembs, Des Moines, IA (US); Alan W. Sheldon, Pella, IA (US)

(73) Assignee: Musco Corporation, Oskaloosa, IA (US)

( * ) Notice: Subject to any disclaimer, the term of this patent is extended or adjusted under 35 U.S.C. 154(b) by 1331 days.

(21) Appl. No.: 13/248,859

(22) Filed: Sep. 29, 2011

(65) Prior Publication Data

US 2012/0081014 A1 Apr. 5, 2012

Related U.S. Application Data

(60) Provisional application No. 61/404,291, filed on Sep. 30, 2010.

(51) Int. Cl.
*H05B 37/02* (2006.01)
*H05B 33/08* (2006.01)

(52) U.S. Cl.
CPC ..... *H05B 33/0872* (2013.01); *H05B 33/0851* (2013.01)

(58) Field of Classification Search
CPC .. H05B 33/08; H05B 37/02; H05B 33/0872; H05B 33/0893; H05B 33/0848; H05B 33/0851; H05B 33/0857; H05B 33/0869; H05B 33/0884; H05B 33/089; H05B 33/0866
USPC ..... 315/291, 224, 225, 307, 308, 209 R
See application file for complete search history.

(56) References Cited

U.S. PATENT DOCUMENTS 5,105,347 A 4/1992 Ruud et al.
5,906,425 A 5/1999 Gordin et al.

(Continued)

FOREIGN PATENT DOCUMENTS

JP 2000350448 A 12/2000
JP 2003188415 A 7/2003

(Continued)

OTHER PUBLICATIONS

English Abstract of KR1020060081902A, Applicant: LG Electronics Inc., filed Jan. 10, 2005, published Jul. 14, 2006 (2 pages).

(Continued)

*Primary Examiner* — Tuyet Vo
*Assistant Examiner* — Amy Yang
(74) *Attorney, Agent, or Firm* — McKee, Voorhees & Sease, PLC

(57) ABSTRACT

The present invention generally relates to the field of large area lighting, such as lighting for sport venues. More specifically, some embodiments of the present invention relate to controlling solid state illumination for various applications including sports lighting, architectural lighting, security lighting, parking, general area, interior, larger area and others. Embodiments according to aspects of the current invention monitor lighting circuits with regard to voltage and current, compare readings with stored models, characterize lighting circuits with regard to stored models for voltage and current, and control lighting circuits in accordance with desirable outcomes.

27 Claims, 9 Drawing Sheets

(56) References Cited

U.S. PATENT DOCUMENTS

| | | | | |
|---|---|---|---|---|
| 6,402,337 | B1 | 6/2002 | LeVasseur et al. | |
| 6,530,675 | B1 | 3/2003 | Van Etten | |
| 6,543,911 | B1 | 4/2003 | Rizkin et al. | |
| 6,679,621 | B2 | 1/2004 | West et al. | |
| 6,814,470 | B2 | 11/2004 | Rizkin et al. | |
| 6,899,443 | B2 | 5/2005 | Rizkin et al. | |
| 6,951,418 | B2 | 10/2005 | Rizkin et al. | |
| 7,023,543 | B2 * | 4/2006 | Cunningham | 356/300 |
| 7,093,961 | B2 | 8/2006 | Bentley et al. | |
| 7,248,002 | B2 | 7/2007 | Yamamoto et al. | |
| 7,300,327 | B2 | 11/2007 | Bolta et al. | |
| D571,495 | S | 6/2008 | Berns et al. | |
| D589,196 | S | 3/2009 | Stone et al. | |
| 7,503,669 | B2 | 3/2009 | Rizkin et al. | |
| 7,618,163 | B2 | 11/2009 | Wilcox | |
| 7,744,246 | B2 | 6/2010 | Rizkin et al. | |
| 7,976,199 | B2 | 7/2011 | Berns et al. | |
| 8,111,011 | B1 * | 2/2012 | Tu et al. | 315/307 |
| 2002/0118542 | A1 | 8/2002 | LeVasscur | |
| 2003/0210555 | A1 | 11/2003 | Cicero et al. | |
| 2005/0068765 | A1 | 3/2005 | Ertze Encinas et al. | |
| 2006/0291218 | A1 | 12/2006 | Pazula | |
| 2007/0200513 | A1 * | 8/2007 | Ha et al. | 315/309 |
| 2008/0037239 | A1 | 2/2008 | Thomas et al. | |
| 2008/0084697 | A1 | 4/2008 | Eberhard | |
| 2008/0192480 | A1 | 8/2008 | Rizkin et al. | |
| 2008/0273333 | A1 | 11/2008 | Berns et al. | |
| 2009/0079360 | A1 * | 3/2009 | Shteynberg et al. | 315/291 |
| 2009/0102396 | A1 * | 4/2009 | Petrucci et al. | 315/294 |
| 2009/0284966 | A1 | 11/2009 | Crookham et al. | |
| 2010/0002432 | A1 | 1/2010 | Romano | |
| 2010/0103672 | A1 | 4/2010 | Thomas et al. | |
| 2010/0290225 | A1 | 11/2010 | Rizkin et al. | |
| 2011/0006689 | A1 | 1/2011 | Blanchard et al. | |
| 2011/0031903 | A1 * | 2/2011 | Nguyen Hoang et al. | 315/309 |
| 2011/0083460 | A1 | 4/2011 | Thomas et al. | |

FOREIGN PATENT DOCUMENTS

| | | | |
|---|---|---|---|
| JP | 2007324493 | A | 12/2007 |
| KR | 1020060081902 | A | 7/2006 |
| KR | 1020080034316 | A | 4/2008 |
| WO | 0186198 | A1 | 11/2001 |
| WO | 2008123960 | A1 | 10/2008 |
| WO | 2010042186 | A2 | 4/2010 |
| WO | 2012044824 | A2 | 4/2012 |

OTHER PUBLICATIONS

English Abstract of KR1020080034316A, Applicant: LG Display Co., Ltd., filed Oct. 16, 2006, published Apr. 21, 2008 (2 pages).

English Translation of JP2003188415A, Applicant: Asahi Matsushita Electric Works Ltd., filed Dec. 18, 2001, published Jul. 4, 2003 (4 pages).

English Translation of JP2000350448A, Applicant: Omron Corp, filed Jun. 2, 1999, published Dec. 15, 2000 (5 pages).

English Translation of JP2007324493A, Applicant: Nichia Chem Ind Ltd, filed Jun. 3, 2006, published Dec. 13, 2007 (9 pages).

"100W TRC-100DS Dimming Series—Switch Mode LED Drives—Constant Current", Thomas Research Products, Innovative & Energy Saving Lighting Controls, Huntley, Illinois, 3 pages.

"3021/3023 BuckPuck—Wide Range LED Power Module", LuxDrive by LEDdynamics, Randolph, Vermont, Jul. 2005—Rev. 2.3, Document COM-DRV-3021-00, 9 pages.

"Bollards and Pagoda Lights at Deep Discount", Arcadian Lighting, [retrieved on Apr. 29, 2007 from the Internet: http://www.arcadianlighting.com/bollard-and-pagoda-lights.html], 4 pages.

"Cie Technical Report—Glare Evaluation System for Use within Outdoor Sports and Area Lighting", CIE 112-1994, 15 pages.

"Control-Link", Musco Sports Lighting, LLC, www.control-link.com, 2011, 1 page.

"Control Link—Flexible control and solid management of your facility, saves operating costs and improves service", Musco Corporation, Oskaloosa, Iowa, 2003, 2005, 9 pages.

"Cree XLamp XP-E LEDs"—Product Family Data Sheet, Durham, North Carolina, www.cree.com/xlamp, 2008-2010, 16 pages.

"IESNA Lighting Education—Fundamental Level", IESNA ED-100, Illuminating Engineering Society of North America, 3 pages.

"Lighting Answers—Light Pollution", NLPIP, Lighting Research Center, vol. 7, Issue 2, Mar. 2003 (revised Feb. 2007), 22 pages.

"Light Trespass: Research, Results and Recommendations", The Lighting Authority, Prepared by the Obtrusive Light Subcommittee of the IESNA Roadway Lighting Committee, IESNA TM-11-2000, 15 pages.

"LUXEON Emitter Technical Data Sheet DS25", Philips Lumileds Lighting Company, 2006, 19 pages.

"LUXEON Radiation Patterns" Philips Lumileds Lighting Company, [retrieved on May 1, 2007 from the Internet: http://www.lumileds.com/technology/radiationpatters.cfm], 1 page.

"MIRO", Anomet Inc., 2006, 2 pages.

Paulin, Douglas, "Full Cutoff Lighting: The Benefits", www.iesna.org, Apr. 2001, 3 pages.

"Simple Guidelines for Lighting Regulations for Small Communities, Urban Neighborhoods, and Subdivisions", International Dark-Sky Association—The Nightscape Authority, www.darksky.org, Tucson, Arizona, 2 pages.

"Thermal Design Using LUXEON Power Light Sources", Philips Lumileds Lighting Corporation, 2006, 12 pages.

* cited by examiner

| Piece Wise Linear Model | Vth = V(10mA) | | | | | | | | | | |
|---|---|---|---|---|---|---|---|---|---|---|---|
| R1 slope 10-20 mA | | | | | | | | | | | |
| R2 slope 20-50 mA | | | | | | | | | | | |
| R3 slope 50-100 mA | | | | | | | | | | | |
| R4 slope 100-200 mA | | | | | | | | | | | |
| R5 slope 200-500 mA | | | | | | | | | | | |
| R6 slope 500-1000 mA | | | | | | | | | | | |
| R7 slope 1000-1500 mA | | | | | | | | | | | |
| | | | | | | | | | | | |
| Vth | 33.106 | 32.299 | 31.690 | 31.263 | 31.189 | 30.787 | 30.419 | 30.100 | 29.740 | 29.379 | 29.050 |
| R1 | 106.801 | 77.835 | 61.325 | 47.531 | 52.202 | 48.102 | 46.964 | 45.902 | 46.389 | 47.749 | 48.412 |
| R2 | 74.271 | 53.506 | 37.887 | 32.628 | 29.915 | 26.863 | 24.972 | 23.597 | 23.184 | 23.135 | 23.134 |
| R3 | 46.691 | 38.588 | 26.952 | 20.727 | 20.525 | 16.921 | 15.086 | 13.798 | 12.726 | 12.744 | 12.502 |
| R4 | 28.067 | 26.129 | 21.637 | 16.632 | 16.949 | 12.820 | 10.989 | 9.792 | 9.296 | 8.736 | 8.341 |
| R5 | 15.749 | 15.257 | 14.121 | 12.501 | 12.757 | 10.084 | 8.284 | 7.084 | 6.543 | 5.937 | 5.681 |
| R6 | 8.919 | 8.721 | 8.507 | 8.179 | 8.117 | 7.562 | 6.698 | 5.725 | 4.961 | 4.618 | 4.358 |
| R7 | 6.038 | 6.049 | 6.038 | 5.895 | 5.630 | 5.610 | 5.293 | 4.835 | 4.345 | 3.975 | 3.740 |
| Temperature | -38.12 | -19.93 | 0.22 | 20.02 | 24.48 | 41.63 | 60.49 | 80.42 | 100.20 | 119.83 | 139.75 |

Fig. 5

APPARATUS, METHOD, AND SYSTEM FOR LED FIXTURE TEMPERATURE MEASUREMENT, CONTROL, AND CALIBRATION

CROSS-REFERENCE TO RELATED APPLICATIONS

This application claims priority under 35 U.S.C. §119 to provisional application Ser. No. 61/404,291 filed Sep. 30, 2010, herein incorporated by reference in its entirety.

I. BACKGROUND OF THE INVENTION

The present invention generally relates to the field of large area lighting, such as lighting for sport venues. More specifically, some embodiments of the present invention relate to controlling solid state illumination for various applications including sports lighting, architectural lighting, security lighting, parking, general area, interior, larger area and others.

LED lighting has many potential advantages for use in large area lighting. These benefits may include long life, efficient lighting, high intensity lighting, variability, etc. Optimizing these benefits is one goal of the lighting designer which would be facilitated by being able to measure operational status of LEDs.

Several known conditions affect normal LED operation. First, light output from LEDs normally varies as a function of junction temperature. During normal operation, LED junction temperature begins at ambient temperature, then increases until after some elapsed time period when thermal equilibrium is attained. During this elapsed time period, as junction temperature increases, output lumens per input watt decrease, which normally results in decreased fixture lumen output, since LED drivers typically provide a constant current level regardless of ambient temperature or LED temperature. Thus an LED fixture typically provides the most light when first powered on, and decreases in output as it warms up until it reaches thermal equilibrium.

Local climatic conditions also affect LED operation. A light being operated in cooler conditions will start at a lower temperature, initially put out a greater amount of light, and take longer to warm up to thermal equilibrium. Conversely, a light being operated in warmer ambient conditions will initially not deliver as much light, and will not take as long to reach thermal equilibrium.

For example, in the case of an LED fixture having a fixed power of 100 watts (W), operating in "normal" ambient conditions—possibly 70° F.—in order to achieve 30 foot candles (fc) illumination at steady-state conditions, it will provide much more than 30 fc, possibly on the order of 30% more, when it is cold and is first turned on. If the current could be reliably controlled, it might be possible to operate the fixture at 70 watts initially, gradually increasing the power as the fixture approached thermal equilibrium. Thus, for a time, the fixture would operate at reduced power, thereby reducing operating cost and reducing degradation of the LEDs.

If the same light is operated at low ambient temperatures, such as cold outdoors, ice rink, etc., a way to control current while maintaining the desired illumination level might make it possible to operate at 50 W initially and still provide 30 fc illumination.

If the same light is operated at high ambient temperatures, e.g. possibly desert conditions, the same lamp might operate at 90 watts initially for a 30 fc output. From the initial higher starting temperature, temperature will rise rapidly and output will decrease rapidly since heat is lost less quickly in higher ambient temperatures. Thus wattage required to maintain 30 fc will increase rapidly and lumen output per watt will decrease accordingly. Also, the thermal equilibrium point will be higher, which would typically reduce light output below the desired level, since the LEDs would be operating at a higher steady-state temperature. Thus a way to control current while maintaining the desired illumination level might make it possible to compensate for the operational differences and still provide 30 fc illumination. However in high ambient temperatures, and for LEDs operated at relatively high power levels, there is a risk of operating at an unacceptably high junction temperature, which can result in decreased life expectancy or premature failure.

Therefore, a way to manage LED fixtures and/or light sources which would reduce or eliminate the variance between initial and steady-state operation and/or compensate for the additional variance of ambient conditions would be highly desirable.

Furthermore, LEDs experience lumen loss, which is a gradual reduction over time in their ability to produce light. The rate of lumen loss is related to the junction temperatures and currents applied over time. Lumen loss is greater when LEDs are operated at higher temperatures and at higher currents. Thus reducing junction temperature and/or operating current for a portion of the operating time will reduce the degradation of the LED, extending its useful life. Thus, there is room for improvement in the art.

LED manufacturers typically provide information about an LED product only under limited operating conditions. For example, they may supply a comparison of forward voltage, current, and lumen output at 25° C. Since most LED fixtures will not operate at a steady temperature of 25° C., much more information about LED performance in situ would be of great benefit in the industry. Therefore, the ability to characterize LED light sources with regard to operational conditions and states is very desirable. This particularly includes information regarding lumen output and potential failure conditions, junction temperature vs. current vs. forward voltage LEDs for area lighting are normally operated in fixtures containing multiple LEDs. These multiple LEDs are often connected in series 'strings' which can make fixture design and control more economical or provide better lighting. However, this introduces additional components into the operating circuit which can make it more difficult to observe LED operational status. Methods to account for these additional components as a part of observing light source and fixture status would be highly beneficial in the industry.

It is therefore a principle object, feature, advantage, or aspect of the present invention to improve over the state of the art or address problems, issues, or deficiencies in the art.

II. SUMMARY OF THE INVENTION

Embodiments according to aspects of the current invention monitor lighting circuits with regard to voltage and current, compare readings with stored models, characterize lighting circuits with regard to stored models for voltage and current, and control lighting circuits in accordance with desirable outcomes.

Further embodiments according to aspects of the current invention monitor lighting circuits with regard to voltage and current, compare readings with stored models, characterize lighting circuits with regard to voltage, current, and time, and control lighting circuits in accordance with desirable outcomes.

Further embodiments according to aspects of the current invention monitor lighting circuits with regard to voltage, current, and time, compare readings with stored models, characterize lighting circuits with regard to voltage, current, and time, and control lighting circuits in accordance with desirable outcomes.

Further embodiments according to aspects of the current invention monitor lighting circuits with regard to voltage, current, and time, compare readings with stored models, characterize lighting circuits with regard to voltage, current, and time, and temperature, and control lighting circuits in accordance with desirable outcomes.

Further embodiments according to aspects of the current invention monitor lighting circuits with regard to voltage, current, and time, compare readings with stored models, characterize lighting circuits with regard to voltage, current, time, temperature, and lumen output, and to control lighting circuits in accordance with desirable outcomes.

Further embodiments according to aspects of the invention model or characterize solid state lighting circuits with regard to one or more of the following: "dynamic resistance," lumen output, number of operating or failed lighting units, number of circuits substituted for failed lighting units, temperature, predicted temperature change due to thermal mass; control lighting circuits to create desirable outcomes, using both closed-loop and open loop control strategies to provide certain benefits or control certain parameters. Open-loop strategies are used to provide benefits including but not limited to failure control or mitigation based on previously established limits by limiting or eliminating current flow in a lighting circuit. Closed-loop strategies are used to provide benefits including but not limited to iteratively adjusting current to provide desired results in the lighting circuit such as controlling (decreasing or increasing) temperature, increasing or decreasing efficacy, increasing or decreasing efficiency, increasing or decreasing longevity, increasing or decreasing lumen output.

III. BRIEF SUMMARY OF THE DRAWINGS

FIG. 5 shows a table illustrating resistance in Ohms vs. voltage for certain LEDs according to aspects of the invention.

IV. DETAILED DESCRIPTION OF EXEMPLARY EMBODIMENTS OF THE INVENTION

Background

Figure 1:
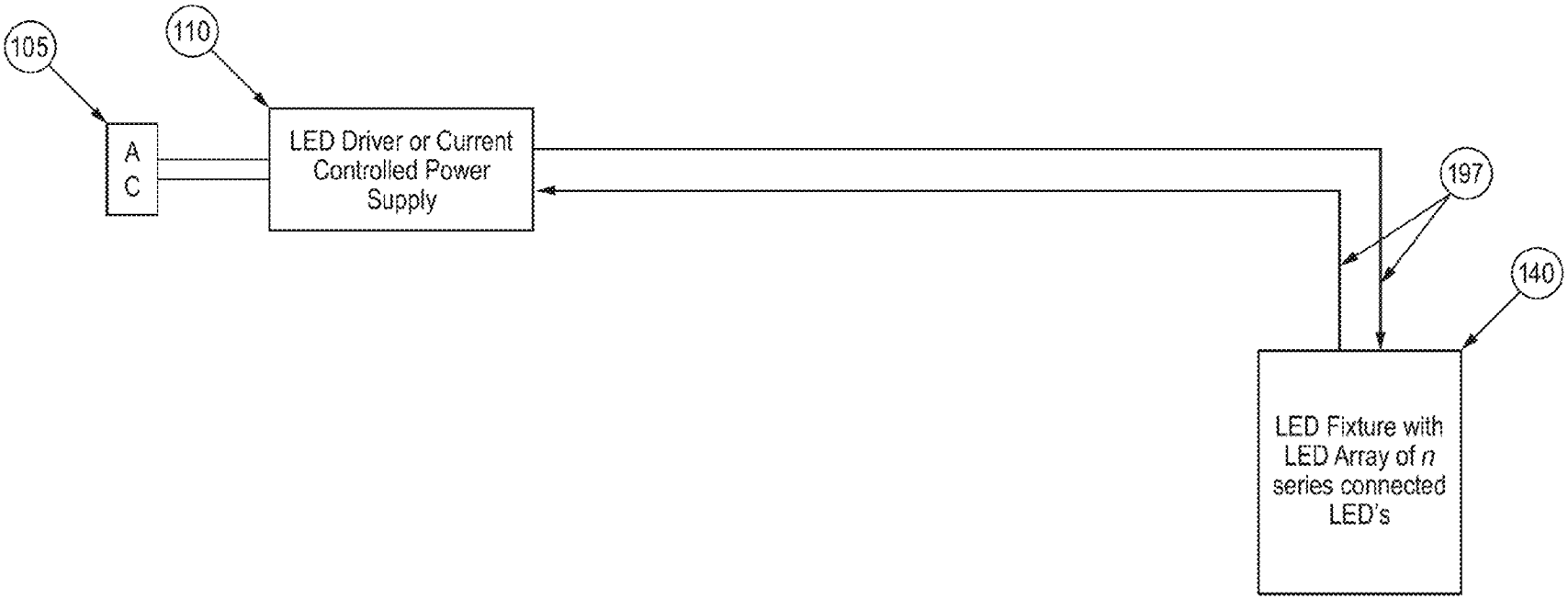
FIG. 1 shows a typical lighting system using an AC power source, driver, supply wiring, and LED fixture.

LED lighting has many potential advantages for use in large area lighting. These benefits may include long life, efficient lighting, high intensity lighting, variability, etc. Optimizing these benefits is one goal of the lighting designer which can be facilitated by being able to measure and evaluate information about operational status of LEDs and associated circuits. Sensing current applied vs. voltage applied can provide information about the operating conditions of the string of LEDs, average state of individual LEDs, and state of the associated drive/control circuit. This information can include the average operating temperature of a string of LEDs. It can also include information about whether one or more LEDs have shorted in the string, and whether more LEDs are likely to fail. As a result, direct operating parameters can be intelligently controlled. This could enhance the ability to control LEDs for short term life and long term effectiveness, as well as limit the maximum temperature experienced by LEDs in operation, prevent short term (catastrophic) failure caused by thermal stress, increase LED useful life by limiting cumulative damage from overheating, allow control strategies which balance LED life vs. light delivered, and provide other useful benefits.

Additionally, reading in situ condition of LEDs in order to determine other factors is desirable for several additional reasons other than managing junction temperature. For example, it can help prevent or manage LED lighting failure modes. LEDs installed in fixtures are typically connected in series (strings) which may be controlled by a single driver per string, or two or more strings may be connected in parallel. LED drivers are typically of the 'current supply' type where a given current is supplied to the LEDs by adjusting voltage up or down within the limits of the driver. Failure of one or more LEDs by 'shorting' will reduce dynamic resistance of the string. This can lead to a 'cascading failure' where, for instance, the driver is unable to adjust voltage quickly enough to prevent overcurrent, which can in turn cause failure of additional LEDs. Therefore, the ability to sense or predict cascading failures and to reduce, limit, or eliminate their effects is highly desirable. LEDs exhibit particular characteristics in relation to junction temperature. Or for circuits equipped with an overload protection device, information about the status of the device may be derived.

As will become apparent, measuring LED junction temperature can be accomplished by reading voltage and current supplied to strings of LEDs and comparing values over time with a known model. The result is a practical way to measure LED junction temperature. This likewise provides to method to control or limit junction temperature during use and also provides other useful methods for controlling LED operation.

Temperature Modeling Using LED Voltage vs. Current

It is well known that the forward voltage for an LED changes with reference to a given current value as the junction temperature changes. Thus forward voltage vs. current applied to an LED can model junction temperature of the LED.

It may be seen then that for a string of LEDs connected in series, given a specific current through the string, the magnitude of the forward voltage across the string will also change relative to the temperature of each LED junction. Given a fixture having good thermal coupling of each LED to the fixture, such that the temperature variation between various points across the fixture is very small, the variation between each LED junction temperature will likewise be small. This implies that forward voltage vs. current for a string of LEDs may be used to model the "average" junction temperatures of the string of LEDs.

For this to be practical, some assumptions apply: (1) LED forward voltage (rather than other resistance factors) must be the predominant factor determining circuit voltage; (2) the LED current source or "driver" (power supply) must be able to control current through the LED string as the dynamic resistance of the LEDs and other circuit variables change. This may easily be accomplished by using a "current controlled driver" of a type that is commercially available, however other driver schemes, including pulse width modulation (PWM), pulse amplitude modulation (PAM), etc. are possible and included within the scope of embodiments of the invention as envisioned. In the case of a "current-controlled" power source, the driver will typically apply (within limits) whatever voltage is required to maintain a selected current value to the LED or string of LEDs. This means that if conditions change in the circuit, such as LED junction temperature changing, resulting in a changed dynamic resistance, the driver will dynamically vary the voltage up or down in order to maintain the selected current value. An example of such a system is shown in FIG. 1 which includes AC power source 105, driver 110, LED supply wiring 197, and LED fixture 140 which comprises series connected LEDs. (Note: one or more additional drivers 110*a* may also be used.)

However, somewhat in contrast to the idealized "average" model for LED strings, as a result of manufacturing processes, commercially available LEDs typically have some variation in forward voltage vs. current characteristics (sometimes described as the "LED dynamic resistance" or forward conducting resistance). Variations in LED dynamic resistance as well as variations in interconnecting resistances can result in different strings of LEDs having significant differences in total forward voltage characteristics. This variation may be of a greater magnitude than the variation exhibited on a given single string over time. It may also be greater than the variation on a given single string as a result of changing junction temperatures. Therefore, individual strings must be characterized and the results included in operational parameters for a system which attempts to closely monitor and control LED junction temperature. Thus a calibration procedure can be used in order to obtain the forward voltage versus current characteristics for each fixture. This calibration procedure might be accomplished at the final assembly of the fixture in the factory or at some other convenient time.

General Application of Temperature Modeling

Figure 2:
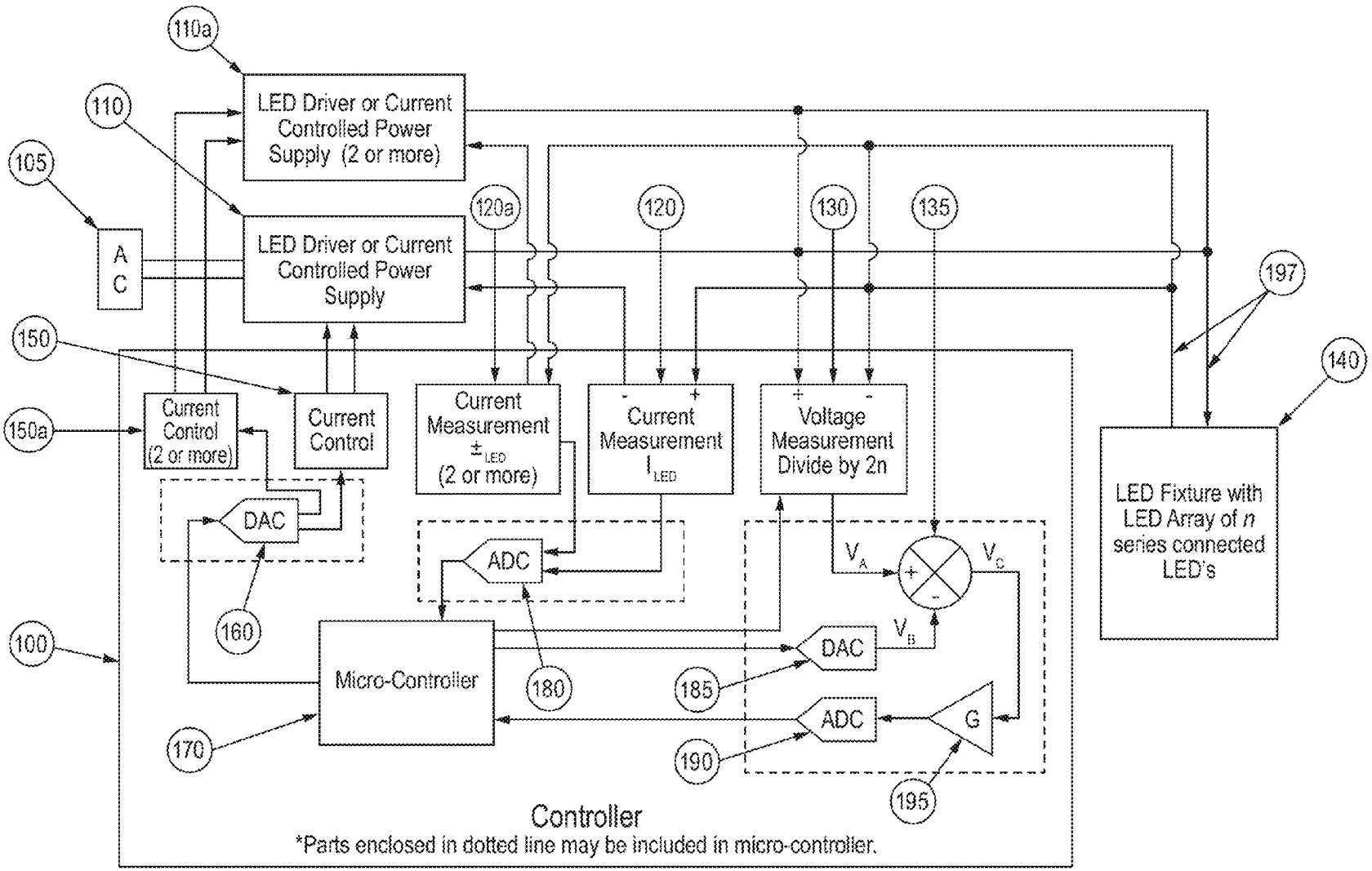
FIG. 2 shows a block diagram of an embodiment according to aspects of the invention.

Some embodiments according to aspects of the invention use an electronic circuit 100, and subcircuits 150/150*a*, FIG. 2, to control the driver 110 (including any additional drivers 110*a*) which supplies current to an array or fixture 140 of high brightness LEDs. This control may be as a function of the LED Junction Temperature, which is sensed using the LED operating voltage and current values measured by the controller. Some embodiments according to aspects of the invention analyze the signal driving the LED string, without adding additional electronics to the LED fixture, and without adding any additional communication system between the fixture and the controller or any wiring to the fixture other than what is needed to power the LEDs. This may also provide additional benefits if it is desirable to mount the controller remotely from the fixture by reducing cost and difficulties related to additional wiring and procedures that would otherwise be needed.

Embodiments according to aspects of the invention can include a temperature sensor function for the LED fixture (i.e. the total LED forward voltage of the fixture), a microcontroller 170 that stores a model of characteristics for the assigned fixture, such as a forward voltage vs. current vs. temperature characteristic for the assigned fixture, and a means 150 for controlling the LED current magnitude according to the sensed temperature.

Among others, one use of an embodiment according to aspects of the invention is to control the LED current in such a manner as to maintain LED longevity goals when the LED junction temperature approaches operational limits.

Some embodiments according to aspects of the invention contain controller circuitry, which could contain the hardware circuits and software algorithms needed to calculate the LED junction temperature, to provide a current vs. temperature calibration of the fixture during fixture production, and to modify or control the current supplied to the LED fixture as needed by the sensed temperature. An embodiment according to aspects of the proposed system is shown in the attached figures.

Some embodiments according to aspects of the invention can monitor LED failures by monitoring the measured voltage that is applied to the LED fixture. Because the LEDs are connected in series, and the source to the LED fixture is a current controlled source, the applied voltage will change in large magnitude steps (i.e. on the order of one or more LED voltage drops) when a short circuit LED failure occurs. The step voltage change for a shorted LED can be included in the calibration data for the fixture. A number of shorted LEDs will be reflected by an integer multiple of the shorted LED voltage step change. Similarly, a step voltage change for an open LED sub-string, when an open LED protection circuit (OLPC) is incorporated with the fixture and becomes activated, can be used to determine the number of activated OLPCs from the fixture voltage measurement data. (An OLPC provides a means to bypass a substring of LEDs within a single string of LEDs controlled by a driver, resulting in a reduced forward voltage across the OLPC in comparison to the substring of LEDs which the OLPC bypasses). Additional discussion of OLPC can be found at US 2011/0006689 A1, now issued as U.S. Pat. No. 8,531,115, incorporated by reference in its entirety herein.

An object according to aspects of the present invention can be to preserve the illumination reliability at high ambient and operating temperatures of the fixture. Further objects may include:

a) optimizing the number of series connected LEDs in a fixture.
b) optimizing the size of the LED fixture power handling capabilities for maximum light output.
c) accurately measuring the LED junction temperatures.
d) providing temperature versus voltage calibration for the LED fixture.
e) controlling the LED fixture current to control the LED junction temperature.
f) correcting the voltage versus temperature calibration for distance between the LED fixture and the controller.
g) determining the number of open LED sub-strings or OLPCs.
h) determining the number of shorted LEDs in the fixture.

Operation

Figure 3:
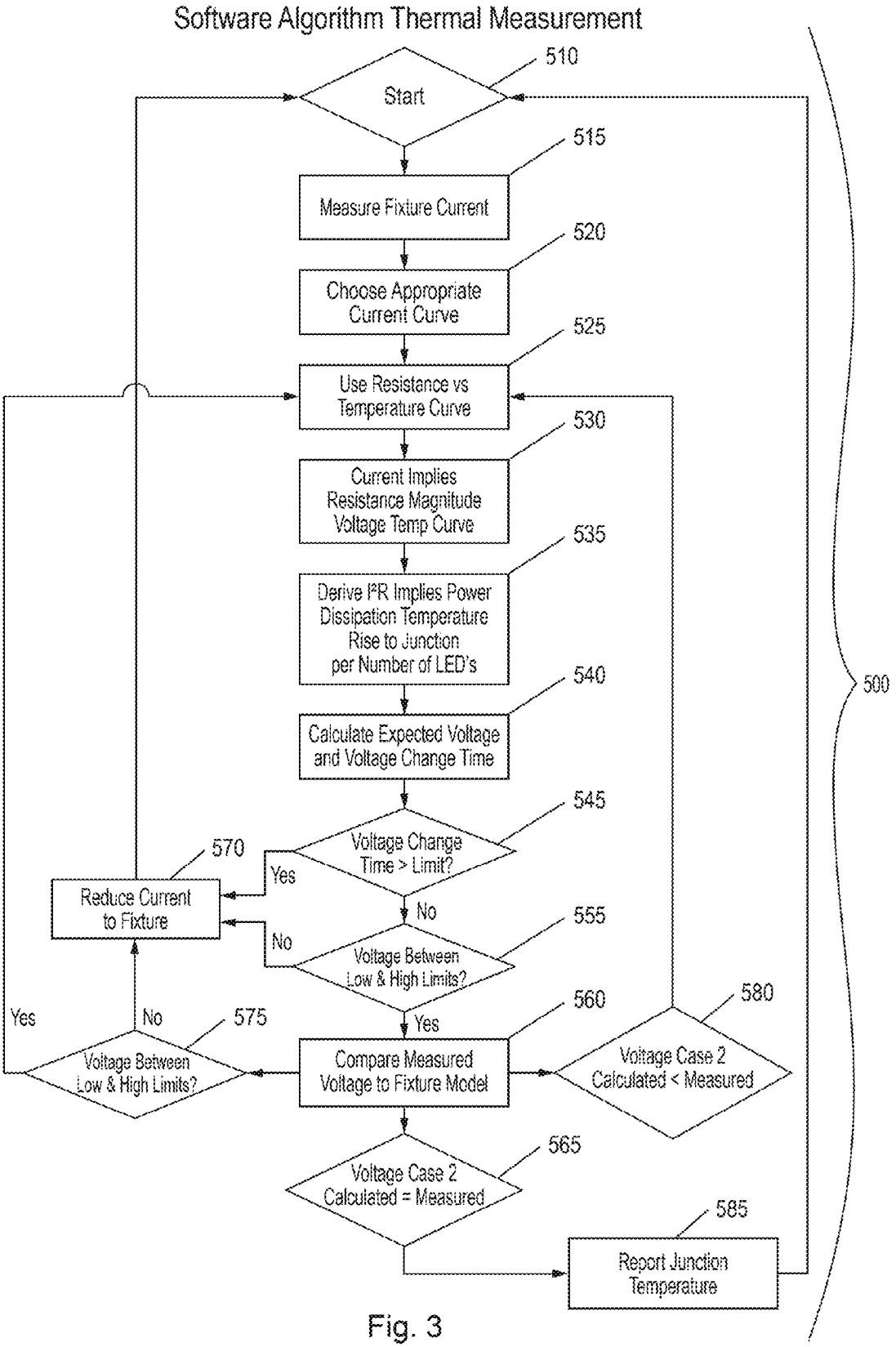
FIG. 3 shows a flow chart illustrating an algorithm for LED fixture control according to aspects of the invention.

Embodiments according to aspects of the invention can function according to the block diagram 500 of FIG. 3, using apparatus according to FIG. 2 or other embodiments.

In this embodiment, control begins at "start" 510. Fixture current is measured, 515. Appropriate "current curve" is chosen, 520. Corresponding resistance vs. temperature curve curve is used, 525. Based on curves, resistance magnitude is inferred from current and voltage, 530. $I^2R$ value is derived from inferred resistance, which implies temperature rise at junction, with consideration for the number of LEDs in the string, 535. Expected voltage and voltage change is calculated, 540. If voltage change over time exceeds a predetermined limit, 545, or if voltage is not between predetermined low and high limits, 555, current to fixture is reduced, 570, and the process repeated. If steps 545 and 555 are within limits, measured voltage is compared to the fixture "model" which was previously characterized, 560 and 575. If calculated voltage is less than measured voltage, 580, the process returns to step 525 to select a different resistance vs. temperature curve. Once the process yields a calculated voltage equal to measured voltage, 565, a validated junction temperature is reported 585 for further evaluation for control purposes. The thermal measurement process then continues to repeat.

Figure 4:
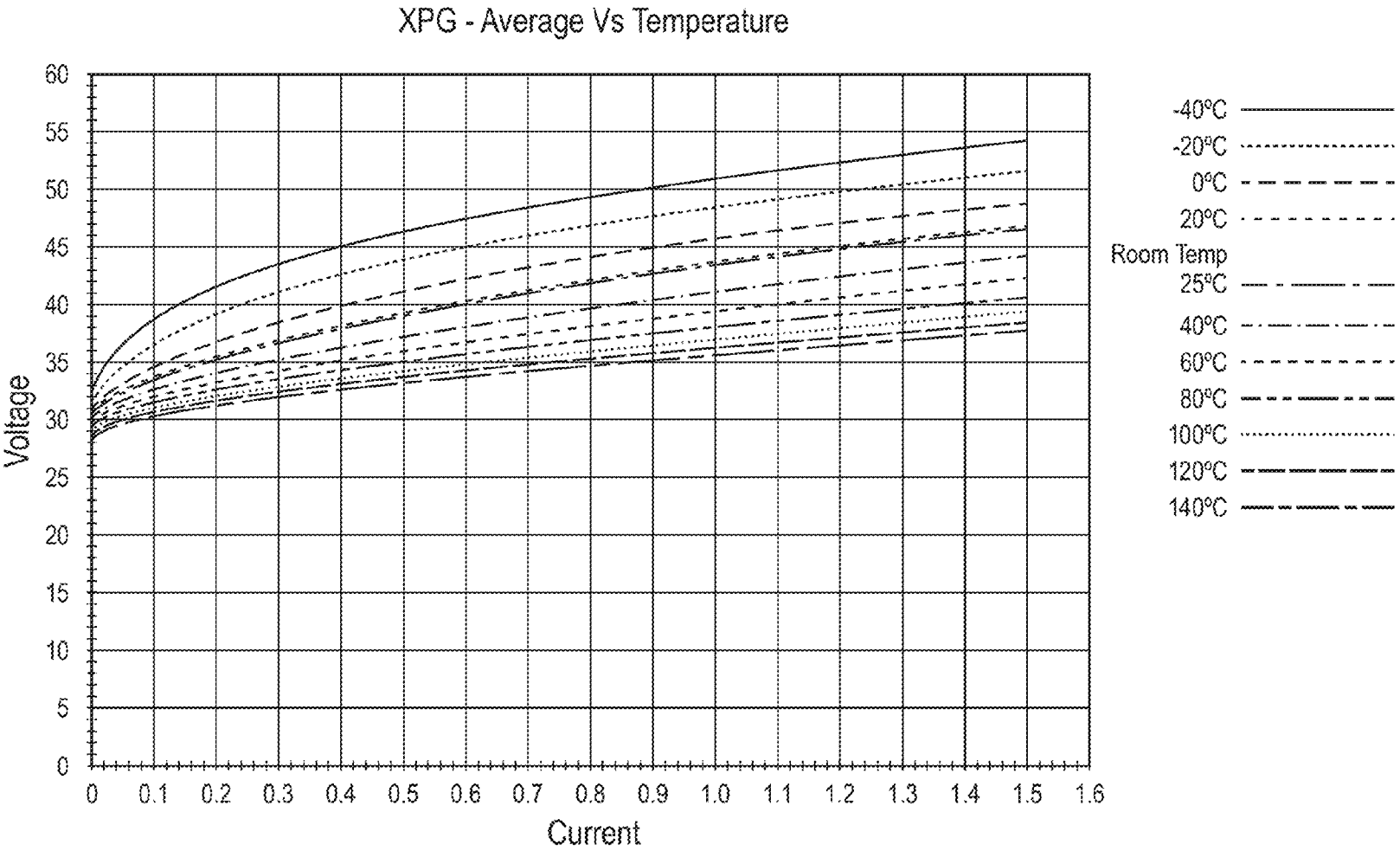
FIG. 4 shows a chart representing a "current curve" exemplifying measured voltage vs. current for a string of LEDs at various temperatures.
Figure 6:
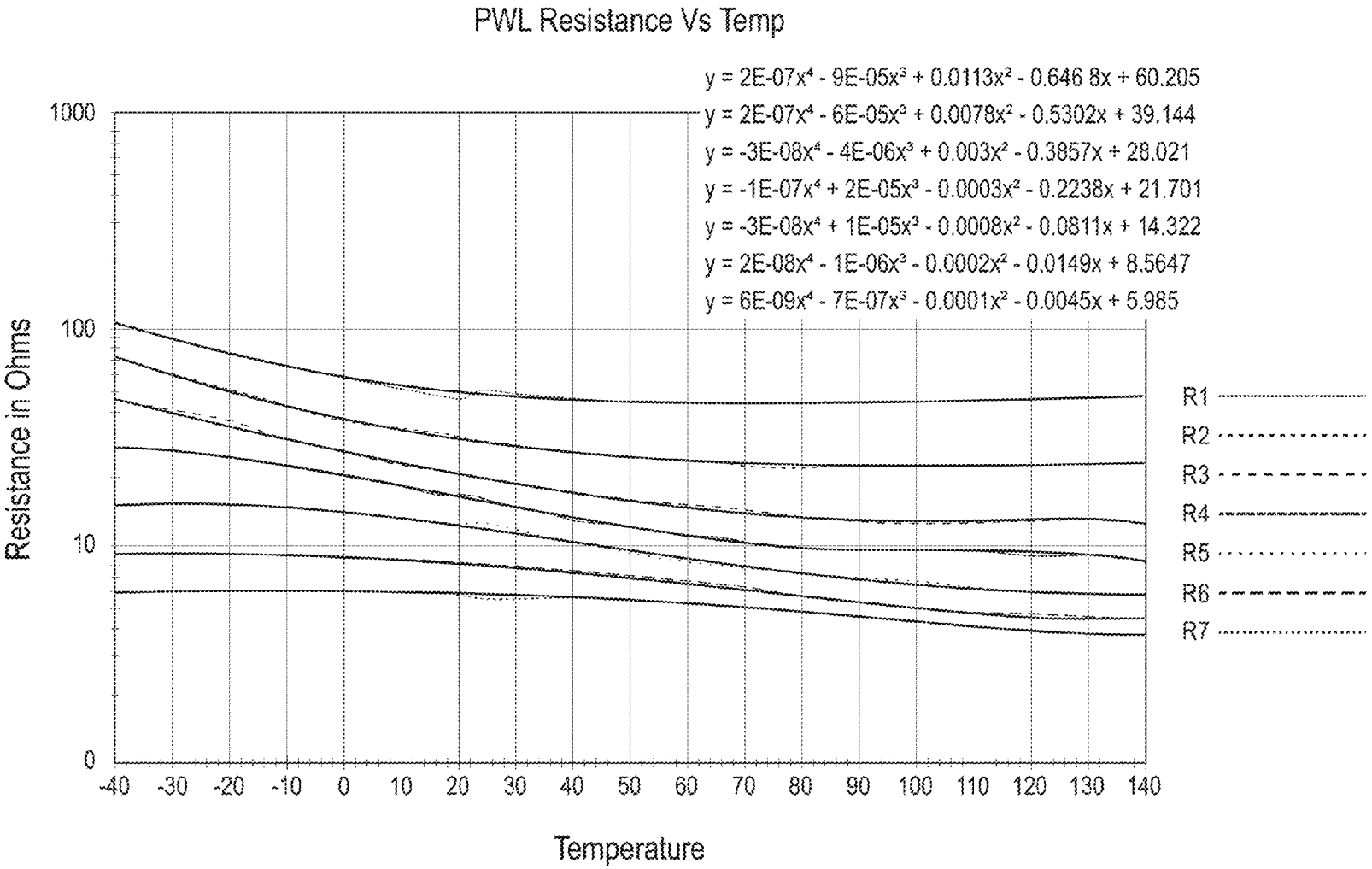
FIG. 6 shows a graph illustrating resistance in Ohms vs. voltage for certain LEDs according to aspects of the invention.

The "current curve" (520, FIG. 3) is illustrated in FIG. 4, which exemplifies measured voltage vs. current curves for a string of LEDs at various temperatures. The "resistance vs temperature curve" (525, FIG. 3) is illustrated in FIG. 6, which exemplifies resistance in Ohms vs. voltage based on the table of FIG. 5, which in turn is derived from the information in FIG. 4 (or similar experimental data).

Figure 7:
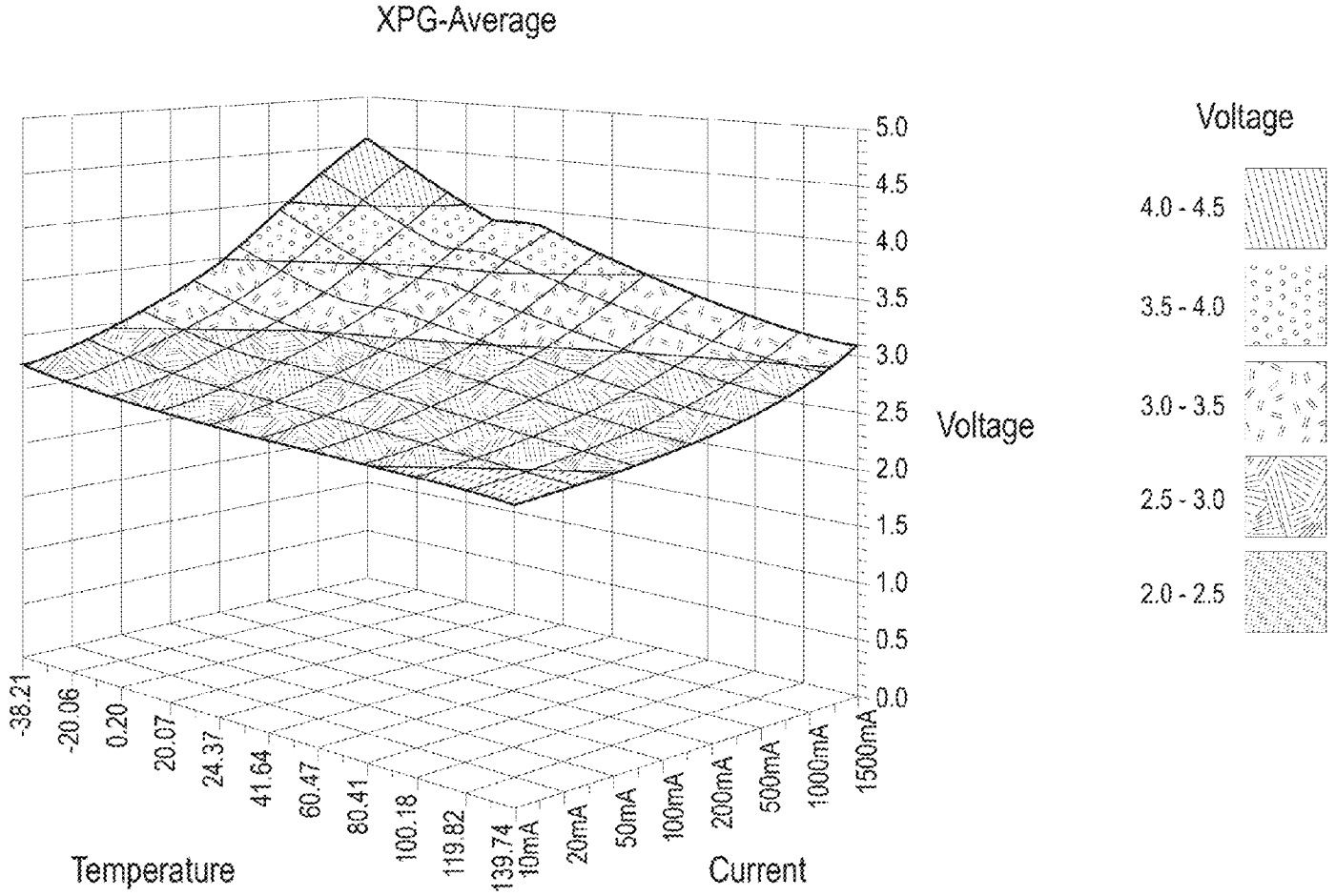
FIG. 7 shows a model of temperature vs. voltage vs. current for a single LED as determined experimentally.

FIG. 7 also models temperature vs. voltage vs. current for a single LED as determined experimentally. It should be noted that the temperature coefficient for a given LED cannot be simply stated as a single value, since it varies with applied current and voltage. This helps to illustrate the necessity of performing complex and iterative calculations in order determine LED junction temperature, as well as some possible benefits of embodiments according to aspects of the invention.

Controller Program

Part of the apparatus, method, and system includes algorithms necessary to change or control the operation of LED fixtures; as discussed below.

Program Parameter Data—Defined by Fixture Design

1. Fixture Thermal Resistance, Rsink-Amb. This is the thermal resistance of the complete thermal circuit from the LED heat sink to the ambient air.
2. LED Voltage Temperature Coefficient, VTC. This is the change in LED forward voltage vs. current over a given temperature range.
3. LED Voltage versus Current Values over range of operating current. This is illustrated in FIG. 4.
4. Number of LEDs in Series String, n.
5. Number of OLPC's (if any) used in LED Series String.
6. The nominal wire resistance, RW, of the interconnecting power lines to the array.

Note that some of the above data may require empirically measuring the devices used in the prototype design.

Calibration Measurements on Specific Fixture:

1. Measure current Ambient Temperature, TAmb. Device should be stable in the current environment.
2. Measure resistance, RW, of wire 197, FIG. 2, between power supply controller 110 (and any additional drivers 110*a*) and the LED Fixture 140.
3. Save TAmb and Rw at the time measurements are made.
4. Measure Series String Voltage, VArrayLow, at the lowest Current, ILow—Used to determine the average threshold voltage, VthLED, for the Series String. Use low duty cycle pulse current measurement to prevent junction temperature rise.
5. Save the values of VArrayLow and ILow.
6. Measure Series String Voltage, VArrayHi, at the maximum operating Current, Imax—Determines String total dynamic resistance, Rd. Use pulse current measurement to prevent junction temperature rise. Current pulse should have fast rise time to avoid junction temperature rise.
7. Calculate Dynamic Resistance, Rd;

$$R_d = \frac{V_{ArrayHi} - V_{ArrayLow}}{n(I_{max} - I_{low})}$$

8. Calculate average threshold voltage, VthLED;

$$V_{thLED} = \frac{V_{ArrayLow} - R_W I_{Low} - R_d I_{Low} - V_{TC}(T_{Amb} - 25^\circ\ \text{C.})}{n}$$

9. Save the calculated value for Rd and VthLED. These are average values for the actual series connected LEDs on the fixture 140. These values are to be used to scale the magnitudes of the nominal LED data table stored in the microprocessor.

Installation Adjustments:

1. Determine the size wire 197 used in the installation.
2. Determine the length wire 197 used in the installation.
3. Calculate the total wire resistance, RW, between the controller board and the LED fixture, using wire tables. The wire resistance specified in tables should be given in Ohms/1000 ft. Then the wire resistance can be calculated using the formula $$R_W = 2L\Omega/1000$$

Where L=the distance between the controller and the fixture;

Ω/1000=the resistance per 1000 ft. of wire for the wire gauge used.

The multiplier of 2 accounts for the distance out and the return distance for the wire connecting the fixture to the controller.

Alternative methods for calculating wire resistance may also be used. For example, wire resistance may be measured if sufficiently accurate instruments are available on-site.

4. Save the parameter value of RW calculated in step 3 in the program.

Obtaining Equation for Voltage vs. Temperature:

The embodiment uses Current and Voltage measurements (measured at 120 and 130, respectively, FIG. 2) of the remote Series LED array 140 to adjust the values of the nominal LED parameters that are stored in the microcontroller 170 program. (In the case of multiple drivers 110*a*, current will additionally be measure at one or more additional points 120*a*.) The voltage versus temperature equation for the series array is given by:

$$V_{Array} = \sum_{k=1}^{n} [V_{thLED_k} + R_{d_k} I_{LED} + V_{TC_k}(T_j - T_{REF})] + R_W I_{LED}$$

Where VthLED=the threshold voltage of the array LED

Rd=the dynamic resistance of the array LED

VTC=the temperature coefficient for the LED

Tj=the LED junction temperature.

TREF=The reference temperature for the parameters or 25° C.

Processing Equations:

The processing equations that will provide the temperature information will require some calculations to extract the temperature information. The stored nominal array LED values will be used to extract the operating junction temperature from the measured voltage. The algorithm is described by the following equations applied to the measured Array Voltage and is shown by the hardware configuration shown in FIG. 2.

The voltage divider furnishes the voltage, VA (which has a magnitude of ½ of a the voltage across a single LED in the array), to a summing node 135 as shown in FIG. 2.

$$V_A = \frac{V_{Array}}{2n} = \frac{\lfloor V_{thLED_{Ave}} + R_{d_{Ave}} I_{LED} + V_{TC_{Ave}}(T_j - T_{REF})\rfloor}{2} + \frac{R_W I_{LED}}{2n}$$

The voltage, VB, of FIG. 2 is furnished by Digital-to-Analog converter 185, and is used to compute the nominal LED temperature independent operating voltage for the LED. VB is derived from the internal stored calibration parameters for VthLED, Rd, and RW along with the measured current ILED (which is furnished to Micro-Controller 170 by Analog-to-Digital converter 180) as follows:

$$V_B = \frac{V_{thLED_{Ave}} + R_{d_{Ave}} I_{LED}}{2} + \frac{R_W I_{LED}}{2n}$$

Subtracting VB from VA gives the result, VC, that is proportional to the junction temperature offset from the reference temperature.

$$V_C = V_A - V_B \cong \frac{V_{TC_{Ave}}}{2}(T_j - T_{REF})$$

The gain, G, of the operational amplifier 195 in FIG. 2 is scaled to provide a voltage range that optimizes the sensitivity and resolution of the Analog-to-Digital converter 190. The value for G and the voltage VD is given in the following equations.

$$G = k\left(\frac{2}{V_{TC_{Ave}}}\right);$$

$$V_D = k(T_j - T_{REF}).$$

Implementation

The described algorithm can be implemented with either analog parts external to the microcontroller, as shown in FIG. 2, or can be implemented within the micro-controller 170. The voltage, VD is equal to the average instantaneous voltage across each LED in the string. It can now be used to set the LED fixture current values as operating junction temperature limits are approached (output from Micro-Controller 170 is supplied through Digital-to-Analog converter 160 to Current Control 150/150*a*).

For some fixtures 140 there may be several independent series strings of LEDs that have independent current control. Each string will need to be measured independently and will result in a number independent voltages, VD1, where 1 is a number identifying the independent strings of the fixture. Each string current could be controlled independently, or the average of all the string values for VD1 could be used as a master value to set all the LED string currents to the same value. The choice would be dictated by the objectives of the fixture design and will be influenced by any temperature variation that may exist across the fixture.

Use in Conjunction with OLPC:

The temperature measurement and control algorithm may also be used for fixtures that employ Open LED Protection Circuits (OLPC). In the event of an open LED, the OLPC will cause a significant shift of the LED Array voltage. The voltage shift is significantly greater, particularly over a short period of time, than the voltage change due to temperature. Consequently, the magnitude shift threshold can be implemented in the controller program to determine an activated OLPC and how many OLPC activations have occurred. Likewise, in the event of one or more shorted LEDs, the LED Array voltage will shift in proportion to the number of shorted LEDs. This shift will also be significantly greater than the voltage change due to temperature, but significantly smaller than the voltage change due to OLPC activation across a multiple LED substring.

By storing the number of OLPC activations or LED shorted failures, the voltage divider can be re-scaled to accommodate the shift in the Array measured voltage. This is indicated by the line connecting the micro-controller to the voltage divider shown in FIG. 2. Implementing OLPC operation or compensating for LED shorted failure would also require adaptive modification of the equations used to separate the temperature information from the array voltage, and modification of the temperature scaling to include the temperature effects of the OLPC or shorted LED. The OLPC or LED short failure temperature correction information can be included in the stored information for the micro-controller. Additionally, diagnostic information concerning the status of the fixture LED array is available through the monitoring of the Fixture Array Voltage.

The controller program can also monitor magnitude of voltage change, or rate of voltage change, over time. Voltage change due to component failure, such as shorted LEDs or activation of an OLPC circuit will occur over a very short time period, in the range of milli- or micro-seconds, whereas voltage change due to temperature change will typically take place over seconds, minutes, or hours. The program can take this into account in order to provide more appropriate control. One example of the benefit of rapidly differentiating between failure-induced voltage change is changing control strategy very rapidly in order to reduce the likelihood of a cascading failure of LEDs due to instantaneous overcurrent caused by a single LED shorting.

Embodiment One

Figure 8:
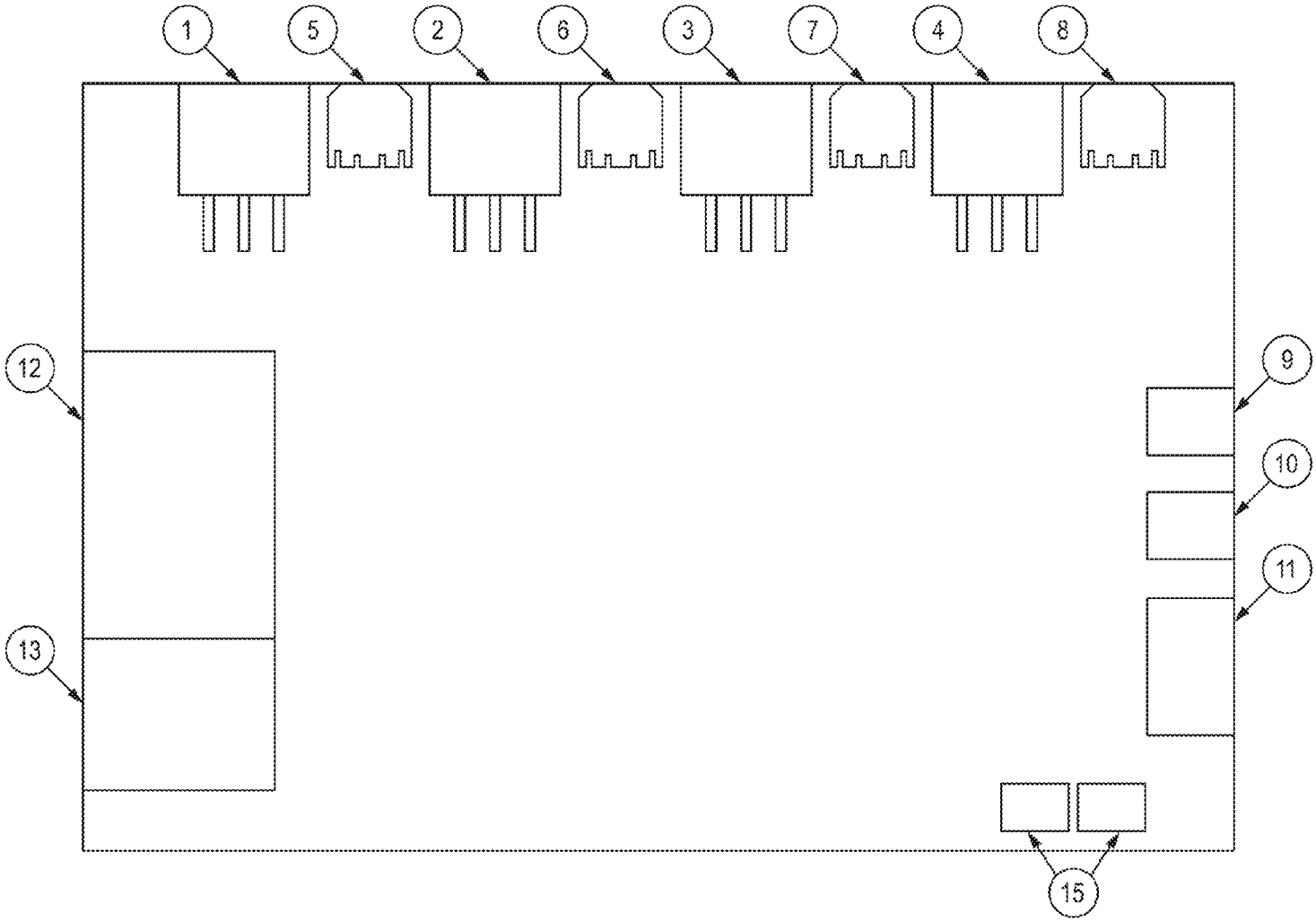
FIGS. 8-9 show top and bottom component outline views of an embodiment according to aspects of the invention.
Figure 9:
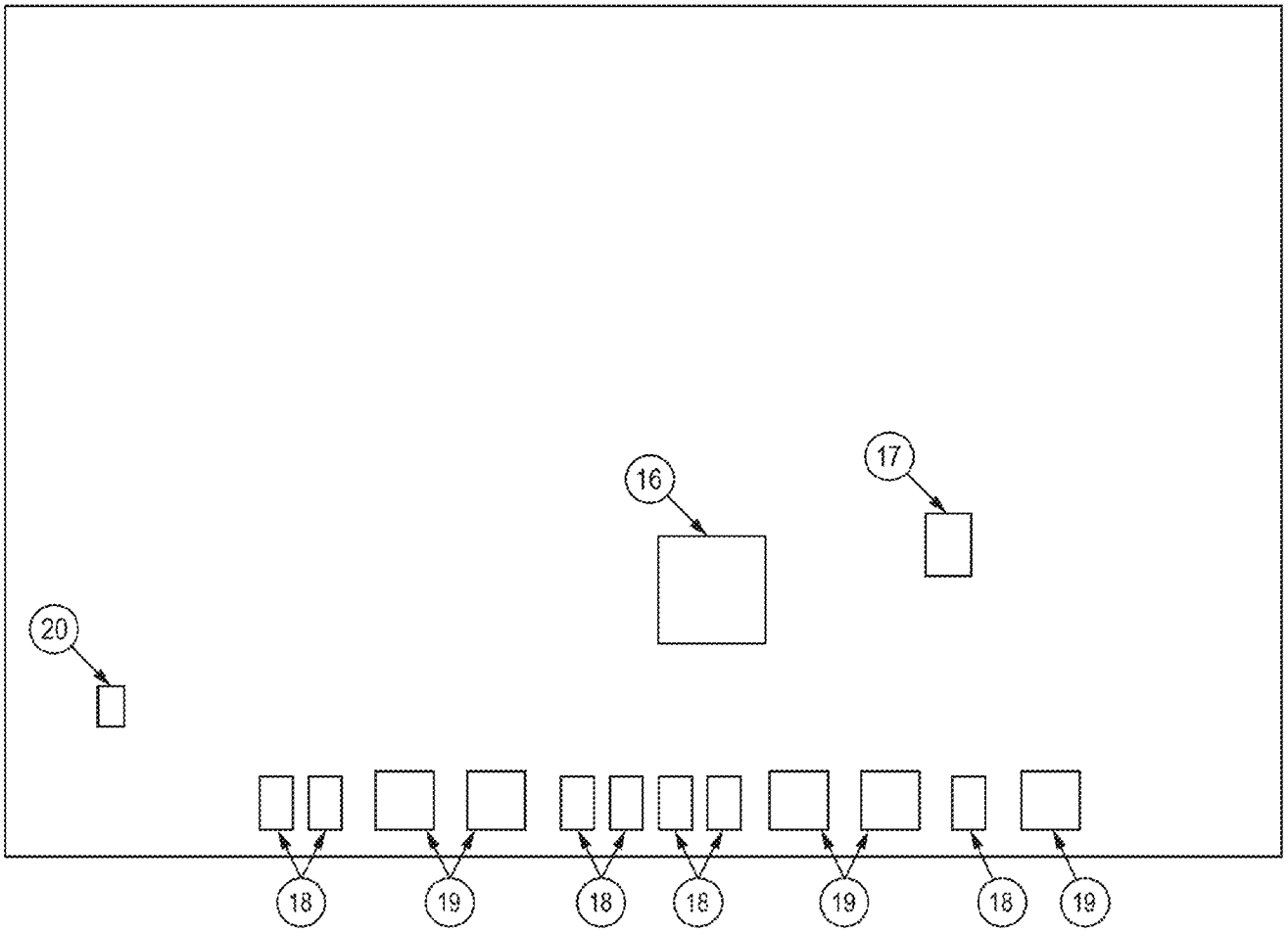

An embodiment according to aspects of the invention comprises a printed circuit board "controller" with attached components as illustrated in FIGS. 8 and 9. The controller includes four separate I/O channels for four separate fixtures or strings of LEDs using four separate current drivers.

Current and control channels are input at connectors 1-4, FIG. 8, from separate LED controllers such as the LED Driver Model TRC-100S105DT available from Thomas Research Products (11548 Smith Drive, Huntley, Ill. 60142). Current to LED fixtures or strings is output at connectors 5-8. Optional 12V input may be supplied at connector 9 and 10. AC current is input at connector 11. A temperature monitor 20 is provided to supply information that may be desired about temperature of the controller and external temperatures such as ambient temperature. Temperature sensors may be connected to the controller board via connectors 15, FIG. 8. Communications links are provided at connectors 12-13, FIG. 8. Buttons 19, FIG. 9 allow user control of some on board functions. A controller IC 16 manages operation of the controller, and may be reprogrammed using the provided interfaces. Flash ROM 17 is included to store data, thermal LED models, and static variables. LEDs 18 indicate system status and provide user feedback when operating the control buttons.

Options and Alternatives

Further improvements or refinements of the basic apparatus, method, and system described herein are envisioned. These of refinement could include increasing the accuracy of the algorithms based on further testing, providing for different responses to sensed current vs. voltage in LED operation, refining hardware through improving accuracy, and reducing costs, etc. Changes in LEDs used in the LED arrays could also necessitate new or revised thermal models or algorithms.

What is claimed is:

1. A method of operating series-connected solid state light sources powered by a power source capable of adjusting current applied to the series-connected lights comprising:

a. instructing the power source to alter current to the series-connected lights based on:
   i. comparing light source current and voltage to a reference;
   ii. the reference based on a previous characterization of the voltage versus current versus temperature of the light sources;
b. wherein instructing the power source to alter current is based on deriving temperature of the solid state light sources,
c. wherein the step of deriving temperature of the solid state light sources is based on current and voltage of the light sources measured at a point in the power line wires between the light sources and the driver or power supply;
d. wherein the measurement of voltage comprises total light source voltage for the series-connected light source/driver or power supply circuit; and
e. wherein the total light source voltage is processed by:
   i. dividing the voltage measurement by 2n, where n is the number of light sources in the series-connected circuit, to present a voltage value of ½ of the series-connected light sources;
   ii. summing the voltage-divided value with a predetermined calibration value to compute a nominal light source temperature-independent operating voltage value, to present a voltage value which is proportional to a junction temperature offset from a reference temperature;
   iii. amplifying the voltage value according to a predetermined gain;
   iv. utilizing the resultant amplified voltage value to set light source current values in the step of instructing the current-controlled driver or power source operation as operating junction temperature limits are approached.

2. The method of claim 1 wherein the temperature of the solid state light sources is the junction temperature.

3. The method of claim 1 wherein the temperature of the solid state light sources is the solder point temperature.

4. The method of claim 1 wherein the temperature of the solid state light sources is the heat sink temperature of the solid state light source.

5. The method of claim 1 wherein the power source comprises a plurality of individual drivers connected in parallel with the solid state light sources.

6. The method of claim 5 where the voltage of the plurality of the individual drivers is measured across the combined power sources, and where the current of the individual power sources is measured and adjusted according to each individual power source.

7. The method of claim 1 wherein the point is closer to the driver or power supply than the light sources.

8. The method of claim 1 wherein the measurement of current is of all light sources in the series-connected light source/driver or power supply circuit.

9. The method of claim 1 wherein the series-connected light sources are housed in a light fixture.

10. The method of claim 1 wherein the series-connected light sources comprises plural sub-sets of series-connected light sources.

11. The method of claim 1 further comprising detecting an open or shorted circuit related to any light source by monitoring light source voltage for a change that exceeds a pre-determined predicted normal amount for the series-connected light because of:

a. a failure of a light source; or
b. activation of an open LED protection circuit.

12. The method of claim 11 further comprising controlling power supply to mitigate additional light source failure.

13. The method of claim 1 wherein the solid state light sources comprise LEDs in a lighting fixture adapted for illumination of a target area.

14. The method of claim 1 to:

a. adjustably control lumen output of the light sources;
b. to maintain relatively constant lumen output of the light sources;
c. to compensate for lumen depreciation of the light sources;
d. to vary drive current to the light sources;
e. to save energy at least for a portion of light source operating time; or
f. to compensate for ambient temperature.

15. A method of operating a circuit of series-connected solid state light sources powered by a driver or power supply capable of controlling current applied to the light source, comprising:

a. monitoring voltage vs. current for the light sources;
b. providing a voltage vs. current calibration at production of the circuit;
c. modifying current to the light sources during operation as a function of monitored voltage vs. current;
d. calculating an estimation of junction temperature of the light sources based on the voltage vs. current calibration at production of the circuit;
e. providing a current vs. junction temperature calibration at production of the circuit;
f. modifying current to the light sources as a function of calculated junction temperature;
g. wherein the step of calculating an estimation of junction temperature comprises:
   i. measuring fixture current;
   ii. choosing an appropriate current curve from curves which have been previously characterized for a given solid state light source or string of solid state light sources;
   iii. selecting a portion of the current curve which provides incremental characterization of resistance vs. temperature;
   iv. deriving expected resistance magnitude from a resistance or voltage vs. temperature curve;

v. deriving an I2R value and therefore an implied temperature rise at the solid state light source junction due to power dissipation;

vi. characterizing said I2R value with regard to number of light sources in a string;

vii. calculating expected voltage based on current and temperature;

viii. comparing expected voltage to actual voltage and either 1. proceeding to controlling current if calculated vs. actual voltage are sufficiently close to have accurately characterized junction temperature or
2. iteratively repeating the process by selecting a different current curve until calculated vs. actual voltage are sufficiently close to have accurately characterized junction temperature.

16. The method of claim 15 comprising monitoring elapsed and/or total cumulative time of operation of the light source.

17. The method of claim 15 wherein the step of calculating an estimation of junction temperature utilizes measurements of light source current and voltage in relation to pre-determined references.

18. The method of claim 15 wherein current to fixture is reduced if it exceeds a pre-selected operating value.

19. The method of claim 15 wherein an estimation of junction temperature that is sufficiently accurate is reported for operational use.

20. The method of claim 15 wherein the calibration is in reference to one or more of:

a. a parameter of the light sources or circuit;

b. a parameter independent of the light sources or circuit.

21. The method of claim 20 wherein the parameter independent of the light sources or circuit comprises ambient temperature.

22. The method of claim 15 wherein the step of modifying current comprises:

a. maintaining light source longevity when light sources are operated in a manner which approaches operational limits;

b. optimizing light source operation in a variety of operating conditions;

compensating for an operational or environmental condition.

23. The method of claim 15 wherein the steps are performed without the addition of components between the driver/power supply and light sources.

24. The method of claim 15 wherein the calibration is utilized in determining the amount of modification of the current, if any.

25. The method of claim 15 wherein the calibration is based on pre-determined criteria that can be stored in the circuit.

26. The method of claim 25 wherein the calibration can be adjusted or changed based on the light sources, the circuit, intended use of the circuit, or other factors.

27. The method of claim 15 wherein the light sources are coordinated in a light fixture for illumination.

* * * * *